United States Patent [19]

Scherrer et al.

[11] 4,200,550

[45] Apr. 29, 1980

[54] PROCESS AND APPARATUS FOR DESALTING CRUDE PETROLEUM

[75] Inventors: Claude Scherrer; Claude Baumann, both of Le Havre; Herbert Wiegandt, Paris, all of France; John-Russel Richmond, High Beach, England; Bernard Siffert, Illfurth; Claudine Bourgeois, Mulhouse, both of France

[73] Assignees: Compagnie Francaise de Raffinage; Universal Matthey Products S.A., both of Paris, France

[21] Appl. No.: 898,426

[22] Filed: Apr. 19, 1978

[30] Foreign Application Priority Data

Apr. 20, 1977 [FR] France ..... 77 11906

[51] Int. Cl.[2] ..... B01D 17/04

[52] U.S. Cl. ..... 252/335; 252/337; 208/188; 208/187; 137/4; 137/92

[58] Field of Search ..... 252/337, 335; 208/188, 208/187; 137/4, 92

[56] References Cited

U.S. PATENT DOCUMENTS 2,446,040 7/1948 Blair, Jr. ..... 208/188 X

FOREIGN PATENT DOCUMENTS 468946 10/1975 U.S.S.R. .

OTHER PUBLICATIONS

FUEL, vol. 53 (Oct., 1974), "Breaking Emulsions of Water in Navy Fuel Oils," Ralph C. Little, pp. 246–252.

*Primary Examiner*—E. Suzanne Parr

*Attorney, Agent, or Firm*—Haseltine, Lake & Waters

[57] ABSTRACT

A process for desalting crude petroleum comprises breaking down a stable emulsion of water and crude petroleum when formed in a desalter, by injecting a demulsifying agent, such as di-2-ethyl hexyl sulphosuccinate, into the desalter at a predetermined level, when the sample taken at this level contain a predetermined content of stable emulsion.

An apparatus for carrying out this process continuously is also included.

9 Claims, 3 Drawing Figures

PROCESS AND APPARATUS FOR DESALTING CRUDE PETROLEUM

BACKGROUND OF THE INVENTION

1. Field of the Invention

This invention relates to a process for desalting crude petroleum and to apparatus for carrying out the process.

2. Description of the Prior Art

Crude petroleum delivered to refineries contains impurities comprising water, salts in solution and also solid particles. Prior to any processing of the crude petroleum, which processing starts with distillation at atmospheric pressure, it is necessary to effect an operation known by the term "desalting" so as to eliminate these impurities and thus avoid as far as possible corrosion in the equipment and solid deposits in the refinery units.

The desalting operation comprises adding water to the crude petroleum and then forming an emulsion so that intimate contact occurs between the water and the petroleum.

The salts contained in crude petroleum thus pass into solution into the water. The emulsion is then conveyed into a desalter in which the water and crude petroleum are separated. In order to accelerate this separation a high-voltage electrostatic field can be produced in the desalter so as to cause the droplets of water to coalesce.

It is also possible to add a demulsifying agent to the crude petroleum before it enters the desalter.

The temperature inside the desalter is between 90° and 150° C.

In the description which follows the following terms are used:

"water phase" means the aqueous layer containing in particular salts in solution which are separated in the lower part of the desalter;

"crude phase" means the layer of crude petroleum which is separated in the upper part of the desalter; and "unstable emulsion" means the emulsion of crude petroleum and water admitted into the desalter.

During the desalting operation a stable emulsion is formed from time to time at the interface of the "water phase" and of the "crude phase". This emulsion, which in the following description will be designated "stable emulsion", cannot be resolved under the temperature conditions prevailing in a desalter and thus it constitutes a separate phase from the "water phase" and the "crude phase".

The "stable emulsion" may contain:

from 49 to 19% by weight of crude petroleum, from 50 to 80% by weight of water, at least 1% by weight of insoluble products.

These insoluble products are constituted by about 50 to 70% by weight of mineral compounds, in particular iron compounds (oxides, sulphide), and 50 to 30% of organic compounds (asphaltenes, carbenes). Asphaltenes and carbenes are bituminous compounds soluble in carbon disulphide; carbenes are insoluble in hot benzene, whereas asphaltenes are soluble therein. According to the temperature, asphaltenes are partially soluble in crude petroleum, whereas carbenes are insoluble therein.

The "stable emulsion" is of the "water in oil" type, the droplets of water being dispersed in the crude petroleum. The insoluble products are concentrated at the periphery and in the interior of the droplets of water.

The stable emulsion may form a layer of quite considerable thickness in the desalter, which is a serious disadvantage since the presence of this thick layer severely interferes with the locating of the level of the water/-crude-oil interface in the desalter.

Now this locating is extremely important since it is necessary to know at all times the position of this level so as to verify whether the separation of crude oil and water (i.e. the desalting operation) is being carried out correctly.

The locating of the interface level is effected by means of a float contained in a vertical guide tube immersed in the desalter. When the "stable emulsion" is formed, it penetrates into the tube and obstructs the float, thus hindering the locating of interface level.

It is possible to remove the stable emulsion rapidly from the desalter, either by continuous skimming through the desalted crude oil, when changing the charge in the distillation unit and using a ligher crude petroleum, for example, or by large-scale mechanical entrainment, following accidental mixing of the phases in the desalter.

The droplets of water, which are charged with insoluble products, are then entrained by the desalted crude petroleum. The insoluble products are then deposited in the exchangers for preheating the crude petroleum arranged upstream of the furnace of the fractionating column. The exchangers rapidly become clogged and this clogging not only necessitates more frequent maintenance operations, but also increased consumption of the fuel required to heat the crude petroleum in the furnace. Moreover, the quality of desalting is reduced as a result of water entrained by the desalted crude oil.

Until now, means have not been found which make it possible to prevent the formation of a thick layer of stable emulsion in a desalter. In fact, the demulsifying agents normally used in desalters, for example products based on copolymers of propylene and ethylene oxide with low molecular weight, are ineffective in breaking down this type of emulsion.

In an article published in the journal *FUEL*, volume 53, pages 246 to 252 (October 1974), R. C. LITTLE describes a demulsifying agent, di-2-ethylhexyl sodium sulphosuccinate, which is capable of resolving stable emulsions of fuel oil and water, and the Applicants have established that this agent is equally effective for stable emulsions of crude petroleum and water, which are formed in a desalter, when it is injected into the stable emulsion.

U.S.S.R. Pat. Specification No. 468,946 does in fact disclose the injection of a demulsifying agent at the level of the stable emulsion formed in a decanter, under different temperature conditions to those prevailing in a desalter, but this patent does not disclose means which enable the formation of a stable emulsion to be detected and the nature of the demulsifying agent used is not specified.

SUMMARY OF THE INVENTION

The Applicants have now discovered that it is possible to resolve stable emulsions in a desalter by detecting the presence of such an emulsion and by injecting into this emulsion a demulsifying agent capable of resolving it. Accordingly, the impurities pass continuously and regularly into the crude petroleum and the afore-mentioned disadvantages are avoided.

In the description which follows:

"first demulsifying agent" means the agent injected into the crude petroleum before it enters the desalter;

"second demulsifying agent" means the agent injected into the desalter, into the stable emulsion, so as to resolve said emulsion.

Therefore, the object of this invention is to rapidly resolve the stable emulsion, shortly after its formation in a desalter, which is liable to be formed therein.

According to the present invention there is provided a process for desalting crude petroleum, said process comprising the following sequential steps:

(A) continuously introducing into a desalter an unstable aqueous emulsion of crude petroleum, said unstable aqueous emulsion optionally containing a first demulsifying agent, (B) resolving said unstable emulsion in said desalter into a water phase and a crude phase, as herein defined, said resolving step being capable of resulting in the formation of an intermediate phase composed of a stable emulsion located between the water phase and the crude phase, and (C) continuously drawing off the water phase and crude phase from the desalter, said process further comprising the following steps:

(a) continuously adjusting of the level of the top surface of the water phase, alternately between predetermined upper and lower limiting levels, whereby at a predetermined level situated between said upper and lower limiting levels there are arranged successively the water phase, the intermediate phase of stable emulsion, when formed and the crude phase;

(b) taking a sample at said predetermined level;

(c) testing whether said sample contains a predetermined minimum quantity of stable emulsion, and (d) if said sample contains said minimum quantity of stable emulsion injecting a second demulsifying agent into the desalter at said predetermined level.

The invention also includes within its scope apparatus for carrying out the process according to the invention said apparatus comprising a desalter;

a means for supplying to the desalter an unstable aqueous emulsion of crude petroleum, optionally containing a first demulsifying agent;

a means for drawing off the water phase from the desalter; and a means for drawing off the crude phase from the desalter; said apparatus further comprising:

(a) means for sampling the product contained in the desalter;

(b) means for determining the nature of the product drawn off by said sampling means;

(c) means for admitting a second emulsifying agent into the desalter, said admission means being situated at the same level as said sampling means;

(d) means connecting the determining means to the admission means for the second emulsifying agent, said connecting means also being adapted to set into operation said admission means, in response to signals received from said determining means.

The invention also embraces crude petroleum and refined petroleum whenever prepared using the process of the invention.

It will be seen that the process according to the invention provides for, in combination, the detection of the presence of stable emulsion inside the desalter and the treatment of said emulsion inside the desalter.

The detection is effected by sampling at a set level in the desalter the product found at this level. The sampling may be effected either continuously or discontinuously, in particular at regular intervals. The sampled product is analysed and, if the analysis reveals the presence of a predetermined content of stable emulsion in the product, the second demulsifying agent is injected at the set level, that is into the stable emulsion.

Detection is accomplished all the more easily if the sampled product consists mainly of the stable emulsion and not, for example, of a mixture of water and stable emulsion containing a high proportion of water.

Therefore, in order to sample a product consisting mainly of stable emulsion, in the process according to the invention a variation of the water level is carried out, for, example by adjusting the flow rate at which the water phase is drawn off from the desalter.

The analysis of the sampled product may be performed using any suitable method. Thus, the Applicants have successfully employed the method involving measuring the viscosity of the sampled product. In fact they have discovered that the viscosity of the stable emulsion at 60° C. can reach 10,000 centipoise, the viscosity of the crude phase being less than 20 centipoise and that of the water phase being less than 1 centipoise. This great difference in viscosities between the stable emulsion and the water and crude phases makes it possible, therefore, to detect the emulsion.

Whenever the sampled product has a predetermined content of stable emulsion, which is preferably equal to at least 70% by weight of the sample taken, there is injected a sufficient amount of the second demulsifying agent to break down the stable emulsion. The demulsifying agent may be injected in solution with water or hydrocarbons, for example.

The second demulsifying agent may be selected from compounds having the formula:

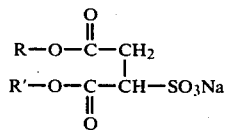

in which R and R′ are straight or branched alkyl radicals whose number of carbon atoms is between 4 and 12.

The Applicants have successfully used, as the second demulsifying agent, di-2-ethylhexyl sodium sulphosuccinate. In the case of this particular agent, the proportion of this agent in relation to the weight of stable emulsion may be between 0.05 and 0.30%, preferably between 0.10 and 0.20.

BRIEF DESCRIPTION OF THE DRAWINGS

The invention will now be exemplified with reference to the accompanying drawings in which.

DESCRIPTION OF THE PREFERRED EMBODIMENTS

Figure 1:
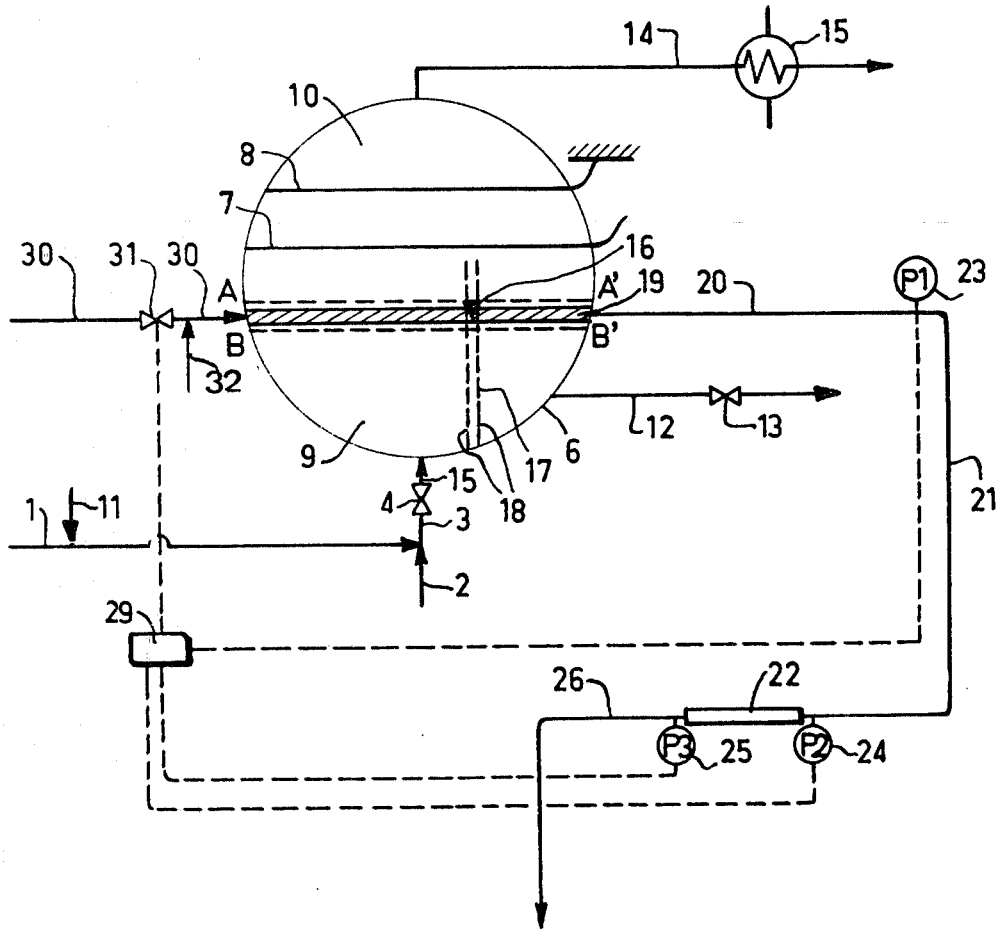
FIGS. 1 and 2 illustrate an apparatus for carrying out the process according to the invention.

Referring firstly to FIG. 1, the crude petroleum to be processed arrives through line 1. Water is introduced into this line 1 through line 2. The mixture of water and crude petroleum is conveyed through line 3 into an emulsifier 4 which comprises a valve, for example. The unstable emulsion formed in this emulsifier is conveyed through line 5 into an electrostatic desalter 6. The desalter is provided with two electrodes 7 and 8 respectively connected to a high-tension supply and to earth. Under the influence of the electrostatic field so produced, the emulsion is separated into two layers, the lower layer 9 consisting of the water phase and the upper layer 10 consisting of the crude phase. A first demulsifying agent may be injected into the line 1 through line 11 so that the unstable emulsion is resolved more rapidly.

The water is removed through a line 12 provided with a valve 13. The desalted crude petroleum is conveyed through a line 14, after having passed through a preheating exchanger 15, into a furnace and a fractionating column (not shown).

The locating of the level of the interface between the layers 9 and 10 is carried out by means of a float 16 contained in a tube 17 provided with orifices 18 which allow liquids to pass through.

Fron time to time a stable emulsion 19 is formed at the interface of the layers 9 and 10. FIG. 1 clearly shows the difficulty involved in precisely locating the level of the interface.

According to the invention the desalter is provided with a system which enables a sample to be taken of the product found in the desalter at the same level as said system. This sampling system is represented diagrammatically here by a line 20. By adjusting the flow rate of the water phase drawn off from the desalter, by means of the valve 13, a variation is brought about in the level of the interface between the levels AA' and BB' which may be separated by a distance of 20 cm, for example.

The line 20 therefore samples in succession the water phase, the crude phase, the water phase and so on. When a stable emulsion is formed at the level of the interface, a sample of said emulsion is taken through the line 20.

The product sampled through the line 20 (water, crude oil or stable emulsion) is conveyed into an apparatus which enables the viscosity of the product to be measured and, therefore, its nature to be determined. This apparatus comprises a calibrated tube 21, a member 22 shown in greater detail in FIG. 2, and three pressure gauges 23, 24 and 25. The drawn-off product is removed from this apparatus through a line 26.

The member 22 comprises a tube of larger cross-section than the tube 21. The interior of the member 22 is provided with partitions 27 pierced by orifices 28. The tube 21 and the member 22 are of such a size that the stable emulsion cannot block them.

The pressure gauges 23, 24 and 25 measure, respectively, the pressures:

$P_1$ upstream of the tube 21, $P_2$ downstream of the tube 21 and upstream of member 22, $P_3$ downstream of the member 22.

The pressure drop in the tube 21 is given by the equation:

$$P_1 - P_2 = k_1 \cdot Q \cdot f(\eta) \quad (1)$$

in which Q is the flow rate and $\eta$ is the viscosity of the product, $k_1$ being a constant dependent on the equipment.

The pressure drop in the member 22, which depends only very slightly on the viscosity, is given approximately by the equation:

$$P_2 - P_3 = k_2 \cdot Q^2 \quad (2)$$

$k_2$ likewise being a constant dependent on the equipment.

Accordingly, $$\frac{P_1 - P_2}{\sqrt{P_2 - P_3}} = K \cdot F(\eta)$$

in which K is a constant.

Therefore, the measuring of pressures $P_1$, $P_2$ and $P_3$ makes it possible to find out the viscosity of the sampled product and, hence, as a result of the great difference in viscosity between water, crude petroleum and the stable emulsion, the nature of the product present in the desalter at the level of line 20.

The desalter 6 is also equipped with a system denoted in FIG. 1 by the line 30 and which makes it possible to admit or introduce into the desalter a second demulsifying agent capable of resolving the emulsion. The admission can take place when the valve 31 provided in the line 30 is in the open position. Preferably the admission system comprises means which enable the demulsifying agent to be spread throughout the layer of stable emulsion. The demulsifying agent is introduced in a quantity sufficient to break down the emulsion.

The opening of the valve 31 is controlled by a regulator 29 which actuates the opening of the valve when the ratio $$\frac{P_1 - P_2}{\sqrt{P_2 - P_3}}$$

measured is equal to a set value corresponding to the presence in the sample taken of a predetermined content of stable emulsion.

The transmission of the pressures $P_1$, $P_2$, $P_3$ to the regulator 29 and also the actuation of the opening of the valve 22 can be carried out by known means, such as pneumatic or electric means.

Furthermore, the Applicants have found that it is preferable to continuously introduce through the line 32 a small quantity of the second demulsifying agent into the system for admitting this second demulsifying agent into the desalter, denoted by the line 30.

In fact this admission is desirable in order to maintain the admission system in a satisfactory operational condition, since the system could become blocked by the deposition on to said system of the stable emulsion present in the desalter but, nevertheless, in a quantity which is insufficient to necessitate the injection of said second demulsifying agent.

This continuous admission of the second demulsifying agent may be effected, for example in the case where the agent is di-2 ethylhexyl sodium sulphosuccinate, at a concentration equal to or less than 8 p.p.m. of sulphosuccinate in relation to the weight of crude petroleum introduced into the desalter through the line 1.

The following examples illustrate the invention, without any limitation thereof.

EXAMPLE 1

Figure 2:
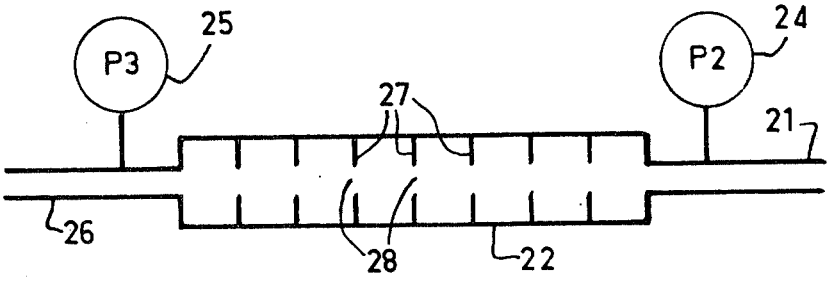

This Example concerns the measurement of viscosity using the viscometer illustrated in FIGS. 1 and 2.

The calibrated tube 21 has an internal diameter of 7.67 mm and a length of 6 m.

The member 22 has an internal diameter of 13.87 mm and a length of 0.15 m. It comprises ten partitions 27 pierced by orifices 28 which are 3.5 mm in diameter.

The pressures $P_1$, $P_2$ and $P_3$ are measured for different samples taken through the line 20 in a desalter processing a petroleum originating from Iraq. The temperature in the viscometer is close to 60° C.

The compositions of the samples taken and the results are given in the following Table.

TABLE

| COMPOSITION OF SAMPLE IN % BY WEIGHT | | | | | |
|---|---|---|---|---|---|
| Stable emulsion | Water | Crude oil | $P_1 - P_2$ in bars | $P_2 - P_3$ in bars | $\frac{P_1 - P_2}{\sqrt{P_2 - P_3}}$ |
| 0 | 100 | 0 | 2.5 | 6.6 | 0.97 |
| 0 | 0 | 100 | 2.7 | 6.75 | 1.03 |
| 35 | 65 | 0 | 2.8 | 6.3 | 1.11 |
| 79 | 0 | 21 | 3.0 | 6.0 | 1.22 |
| 92 | 0 | 8 | 3.5 | 5.5 | 1.49 |

It may be observed from this Table that the greater the quantity of stable emulsion in the sample taken, the higher is the ratio $$\frac{P_1 - P_2}{\sqrt{P_2 - P_3}}.$$

It is thus possible to detect the emulsion.

EXAMPLE 2

This Example concerns the treatment of a stable emulsion with a demulsifying agent consisting of di-2 ethylhexyl sodium sulphosuccinate.

The stable emulsion has the following composition:

water content: 70% by weight, crude petroleum content: 28.5% by weight, impurity content: 1.5% by weight.

The crude petroleum originates from a Saudi Arabian oil field.

33.5 ml of the emulsion are placed in a graduated testtube. The demulsifying agent is added in solution with 1 ml water. The test-tube is closed and shaken by hand for a given length of time so as to cause the demulsifying agent to act. Three tests A,B,C are effected with varying concentrations of demulsifying agent:

for A: 0.24% in relation to the weight of emulsion, for B: 0.12% in relation to the weight of emulsion, for C: 0.16% in relation to the weight of emulsion.

Figure 3:
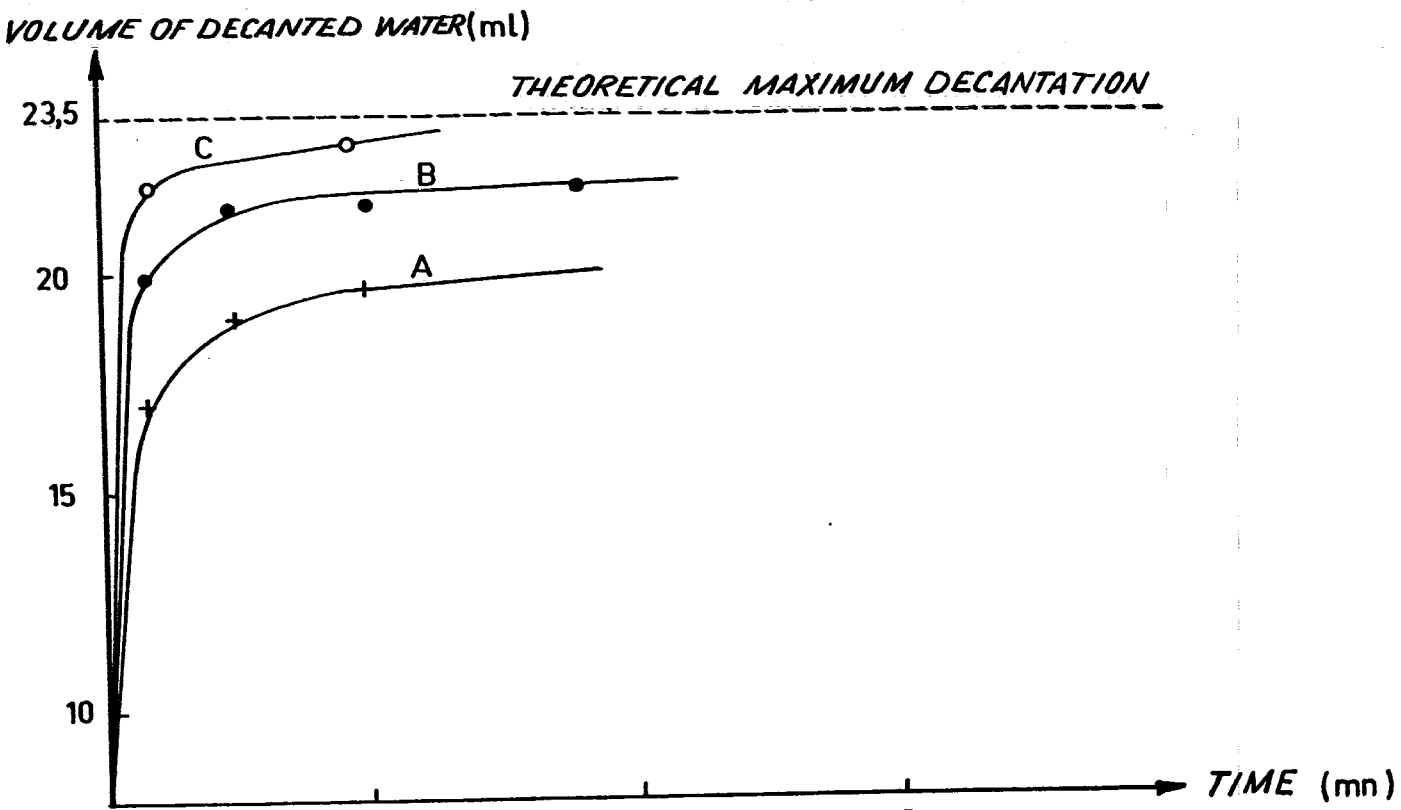
FIG. 3 illustrates an example and will be explained in the description of this example.

The volume of water decanted after varying periods of time is measured. The results were recorded in FIG. 3, in which the volume of water decanted is indicated with respect to time.

It will be observed that the stable emulsion is rapidly resolved, particularly in the case of test C.

We claim:

1. A process for desalting crude petroleum, said process comprising the following sequential steps:

(A) continuously introducing into a desalter an unstable aqueous emulsion of crude petroleum, (B) resolving said unstable emulsion in said desalter into a water phase and a crude phase, said resolving step being capable of resulting in the formation of an intermediate phase composed of a stable emulsion located between said water phase and said crude phase, and (C) continuously drawing off the water phase and crude phase from said desalter, wherein the improvement comprises the following combination of additional steps:

(a) continuously adjusting the level of the top surface of said water phase alternately between predetermined upper and lower limiting levels whereby at a predetermined level situated between said upper and lower limiting levels there are arranged successively said water phase, said intermediate phase of stable emulsion when formed, and said crude phase;

(b) taking a sample at said predetermined level;

(c) testing whether said sample contains a predetermined minimum quantity of said stable emulsion, and (d) if said sample contains said minimum quantity of said stable emulsion, injecting a second demulsifying agent into said desalter at said predetermined level.

2. A process as claimed in claim 1 wherein said injecting of said second demulsifying agent into said desalter is effected when said sample contains at least 70% by weight of said stable emulsion.

3. A process as claimed in claim 1 wherein said testing is carried out by viscometry.

4. A process as claimed in claim 1 wherein said second demulsifying agent is di-2 ethylhexyl sodium sulphosuccinate.

5. A process as claimed in claim 4 wherein the percentage by weight of di-2 ethylhexyl sodium sulphosuccinate injected, in relation to the weight of said stable emulsion, is from 0.05 to 0.30%.

6. A process as claimed in claim 5 wherein the percentage by weight of di-2 ethylhexyl sodium sulphosuccinate is from 0.10 to 0.20%.

7. A process as claimed in claim 1 wherein a small quantity of said second demulsifying agent is continuously injected into said desalter at said predetermined level.

8. A process as claimed in claim 7 wherein said second demulsifying agent is di-2 ethylhexyl sodium sulphosuccinate and wherein said continuous injection is effected at a maximum concentration of 8 p.p.m. of sulphosuccinate in relation to the weight of said crude petroleum introduced into said desalter.

9. A process according to claim 1 wherein, in step A, a demulsifying agent is added to the aqueous emulsion.

* * * * *